US008596014B2

(12) United States Patent
Genest et al.

(10) Patent No.: US 8,596,014 B2
(45) Date of Patent: Dec. 3, 2013

(54) MASONRY BLOCK SYSTEM

(71) Applicants: Christopher R. Genest, Sanford, ME (US); Matthew M. Genest, Sanford, ME (US)

(72) Inventors: Christopher R. Genest, Sanford, ME (US); Matthew M. Genest, Sanford, ME (US)

( * ) Notice: Subject to any disclaimer, the term of this patent is extended or adjusted under 35 U.S.C. 154(b) by 0 days.

(21) Appl. No.: 13/869,148

(22) Filed: Apr. 24, 2013

(65) Prior Publication Data

US 2013/0276400 A1 Oct. 24, 2013

Related U.S. Application Data

(63) Continuation of application No. PCT/US2012/041083, filed on Jun. 6, 2012.

(60) Provisional application No. 61/493,754, filed on Jun. 6, 2011.

(51) Int. Cl.
*E04B 5/04* (2006.01)
*E04C 2/04* (2006.01)

(52) U.S. Cl.
USPC ..... 52/600

(58) Field of Classification Search
USPC ..... 52/600, 602, 603, 604, 605, 606, 607
See application file for complete search history.

(56) References Cited

U.S. PATENT DOCUMENTS 1,167,746 A * 1/1916 Funsten ..... 52/574
2,141,397 A * 12/1938 Locke ..... 52/204.2
2,703,487 A * 3/1955 Ossoinack ..... 52/592.3
2,745,276 A * 5/1956 Kuhlman ..... 52/100
2,786,301 A * 3/1957 Torricelli ..... 446/115
3,295,286 A * 1/1967 Schaich ..... 52/583.1
3,717,967 A * 2/1973 Wood ..... 52/259
3,968,615 A 7/1976 Ivany
4,004,385 A * 1/1977 Kosuge ..... 52/259
4,018,018 A * 4/1977 Kosuge ..... 52/127.4
4,031,678 A * 6/1977 Schuring ..... 52/570
4,148,166 A * 4/1979 Toone ..... 52/309.12
4,167,840 A * 9/1979 Ivany ..... 52/438
4,295,313 A 10/1981 Rassias
4,319,440 A * 3/1982 Rassias et al. ..... 52/438
4,320,606 A * 3/1982 GangaRao ..... 52/125.5
4,473,985 A 10/1984 Hunt
4,485,604 A 12/1984 Palamara et al.
4,527,373 A * 7/1985 Cruise ..... 52/405.1
4,726,567 A * 2/1988 Greenberg ..... 256/19
4,856,248 A * 8/1989 Larson et al. ..... 52/405.1
5,321,926 A * 6/1994 Kennedy ..... 52/405.1
5,365,714 A * 11/1994 Potvin ..... 52/590.2

(Continued)

FOREIGN PATENT DOCUMENTS

EP 0616091 B1 3/2000
EP 1505217 A1 2/2005

*Primary Examiner* — Mark Wendell
*Assistant Examiner* — Keith Minter
(74) *Attorney, Agent, or Firm* — Patricia M. Mathers

(57) ABSTRACT

The invention is a masonry block that is adapted to receive insulation and re-bar. The block has a number of cavities and recesses or grooves in various walls and webs so that re-bar may be laid along a row of blocks, may be inserted vertically through multiple courses of blocks, and may even be inserted diagonally through multiple courses of blocks. The cavities that have re-bar are filled with grout, the other cavities are filled with insulation, either in the form of a rigid foam core, batting, or spray foam.

9 Claims, 11 Drawing Sheets

(56) References Cited

U.S. PATENT DOCUMENTS

| | | | | |
|---|---|---|---|---|
| 5,678,373 | A * | 10/1997 | Franklin et al. | 52/439 |
| 5,899,040 | A * | 5/1999 | Cerrato | 52/604 |
| 6,105,330 | A * | 8/2000 | Nanayakkara | 52/606 |
| 6,244,009 | B1 * | 6/2001 | Cerrato | 52/604 |
| 6,564,524 | B1 * | 5/2003 | Gruita | 52/604 |
| 7,117,647 | B2 * | 10/2006 | Clarke | 52/233 |
| 7,546,712 | B2 * | 6/2009 | Shaw | 52/223.8 |
| 7,584,584 | B2 * | 9/2009 | Fennell, Jr. | 52/607 |
| 7,591,447 | B2 * | 9/2009 | Hammer et al. | 249/104 |
| 8,136,329 | B2 * | 3/2012 | Willis | 52/848 |
| 8,201,370 | B1 * | 6/2012 | Goodwin | 52/285.2 |
| 8,225,578 | B2 * | 7/2012 | Azizi Ronagh | 52/747.1 |
| 2001/0025462 | A1 * | 10/2001 | Laurent | 52/426 |
| 2003/0070388 | A1 * | 4/2003 | Catani et al. | 52/677 |
| 2004/0020145 | A1 * | 2/2004 | Matsufuji | 52/223.7 |
| 2005/0115185 | A1 * | 6/2005 | Telford et al. | 52/596 |
| 2005/0252118 | A1 * | 11/2005 | Matsufuji | 52/223.7 |
| 2006/0000179 | A1 * | 1/2006 | Albert | 52/606 |
| 2006/0059839 | A1 * | 3/2006 | Azar | 52/606 |
| 2006/0248825 | A1 * | 11/2006 | Garringer | 52/233 |
| 2006/0288656 | A1 * | 12/2006 | Clarke | 52/233 |
| 2007/0056235 | A1 * | 3/2007 | Kohler | 52/223.7 |
| 2007/0079566 | A1 * | 4/2007 | Neill et al. | 52/284 |
| 2011/0192097 | A1 * | 8/2011 | Kelley, Jr. | 52/166 |

* cited by examiner

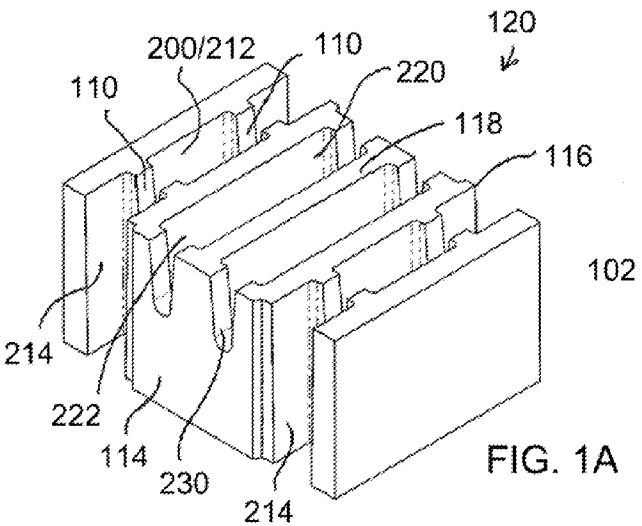
FIG. 1A
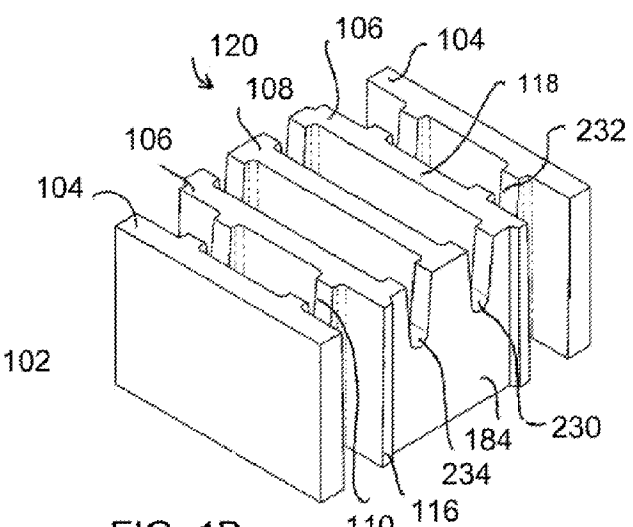
FIG. 1B
FIG. 1C
FIG. 1D

MASONRY BLOCK SYSTEM

BACKGROUND INFORMATION

1. Field of the Invention

The invention relates to a masonry block. More particularly, the invention relates to a building block having cavities for insulation.

2. Discussion of the Prior Art

Masonry blocks are frequently used for building walls of residential and commercial structures. In a conventional masonry block wall, the blocks are laid on bond, that is, the one block covers one half of two blocks below it, so that the vertical joint formed by adjacent blocks in one row does not align with a vertical joint similarly formed in a previous row. The blocks typically have passageways that allow reinforcement bars (hereinafter referred to as "re-bar") to be inserted through the blocks to form a rectangular grid. For example, every four feet in the horizontal direction a re-bar is inserted in the vertical direction through the rows of block in that vertical four-foot length, and every four feet in the vertical direction a re-bar is inserted in the horizontal direction through the blocks that form that four-foot expanse. The re-bar is then tied together to form a rigid grid by filling cement grout into the cavities with the re-bar.

It is highly desirable these days to provide a masonry block that contains insulation material. The fact that re-bar is inserted in masonry blocks makes it difficult to easily and economically provide a masonry block with insulation.

BRIEF SUMMARY OF THE INVENTION

The masonry block according to the invention, which includes a stretcher block, an end block, a corner block, and a half block, has chambers or cavities for receiving insulation and re-bar. The layout of the chambers and recesses in the masonry block is such that, when the blocks are laid on bond, the re-bar may be inserted in the horizontal and vertical directions for rectangular grid reinforcement, and also in diagonal directions for cross-bracing. Cross-bracing provides greater stability for a structure and is a desirable feature of the masonry block, particularly in geographic areas that are subject to earthquakes. The ability to cross brace a structure eliminates the need for other cost-intensive supports. Additional chambers are provided in the block for receiving insulation material. A wall constructed with this masonry block thus has greater strength and rigidity than a conventional masonry block wall and a greater insulation value. The wall construction is less expensive than conventional construction and has a positive environmental impact, because of a reduced amount of energy that is required to heat or cool a building constructed with the masonry block according to the invention.

BRIEF DESCRIPTION OF THE DRAWINGS

The present invention is described with reference to the accompanying drawings. In the drawings, like reference numbers indicate identical or functionally similar elements. The drawings are not drawn to scale.

FIG. 1A is a first perspective view of a stretcher block, showing the top face, the first wall face, and the first end face with a male connector.

FIG. 1B is a second perspective view of the stretcher block, showing the second end face with a female coupler and the second wall face.

FIG. 1C is a third perspective view of the stretcher block, showing the bottom face and first wall face.

FIG. 1D is a fourth perspective view of the stretcher block, showing the second wall face.

DETAILED DESCRIPTION OF THE INVENTION

Figure 1E:
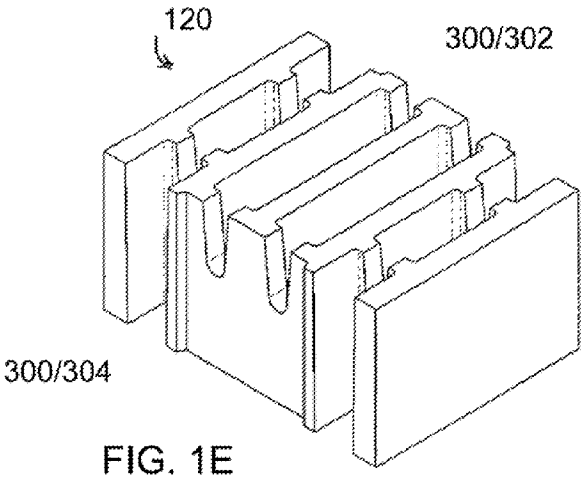
FIG. 1E is a fifth perspective view of the stretcher block, showing the second end face and the second wall face.
Figure 1H:
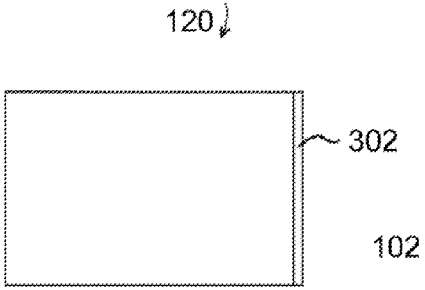
FIG. 1H is a planar view of the wall face of the stretcher block.

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

The invention is a masonry block 100 for building masonry block walls. The masonry block 100 is constructed to receive re-bar and/or insulation material. The re-bar may be inserted through the blocks to form the conventional rectangular re-bar grid, or be inserted diagonally. The insulation material may be in the form of a rigid foam block, batting, or spray foam insulation.

The term "masonry block 100" is a general term for the block according to the invention and includes a stretcher block 120, a half block 140, an end block 160, and a corner block 180. Incorporated into each block 100 are one or more chambers or recesses 200 for receiving re-bar and/or insulation, as well as a connector means 300 for mating adjacent blocks with each other. The general shape of the blocks 100 is rectangular, whereby the generally rectangular outer perimeter has one or more indentations, protrusions, and/or cavities on one or more of the faces of the particular block. Each block has two wall faces 102 that form opposite sides of the block and are the faces of the block that are visible on the two faces of a wall, and each block has a first end face 114 and a second end face 116, a top face 118, and a bottom face 119. Elements that are functionally identical in the various blocks 120, 140, 160, and 180 retain the same reference designation.

Figure 1F:
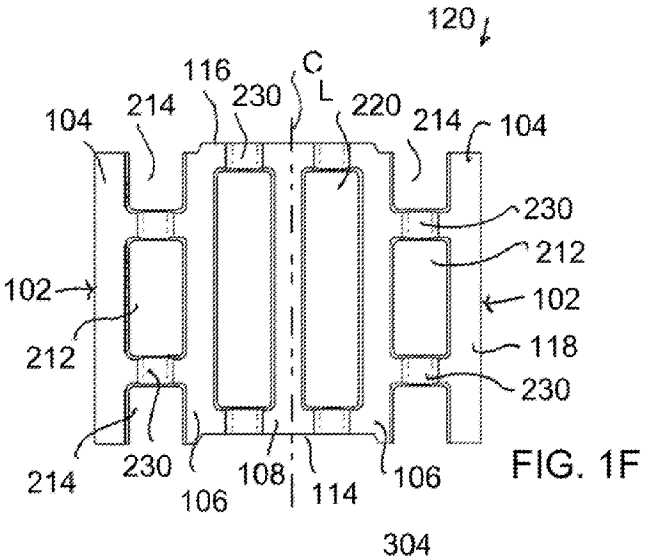
FIG. 1F is a planar view of the top face of the stretcher block.
Figure 1G:
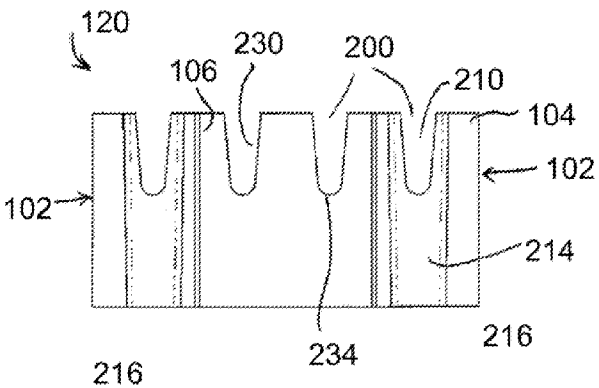
FIG. 1G is a planar view of the second end face of the stretcher block with female connector.

FIGS. 1A-1H illustrate the stretcher block 120, whereby FIGS. 1A-1E are perspective views that show all six faces and FIGS. 1F-1G planar views of various faces of the block 120. The wall faces 102 are mirror-reverse images of each other and, thus, one reference designation shall be used to indicate one or both of the wall faces. The connector means 300 on the stretcher block includes a male connector 302 on the first end face 114 and a female connector 304 on the second end face 116. When two stretcher blocks 120 are assembled adjacent one another on a row, the male connector 302 on the first end face 114 mates with the female connector 304 on the second end face 116 of the adjacent block.

The FIGS. 1A-1G show a plurality of chambers, recesses and cavities 200. The stretcher block 120 is constructed symmetrically about a centerline $C_L$. Two center chambers 220 are provided in the center portion of the block 120, that portion that is within the bounds defined by the male and female connectors 302,304 on the end faces 114, 116, respectively. The center chambers 220 extend parallel to each other and are equidistant from each side of the centerline $C_L$, with a center web 108 separating the two chambers. An intermediate web 106 separates a respective one of the center chambers 220 from an outer chamber 212. The end faces 114 and 116 form the end boundaries of the center chambers 220, and, in the embodiment shown, the center portion of the end faces. The outer cavity 212 is bounded by an outer web 104, which also forms the wall face 102, the intermediate web 106, and, on the ends toward the end faces 114,116, by cavity wall 110, which is a recessed wall and best seen in the view shown in FIG. 4G. The cavity wall 110 also forms an outer recess 214. When the stretcher block 120 is placed adjacent any of the other types of blocks 100, each block will have an outer recess that aligns with the outer recess 214 of the stretcher block 120. In the embodiment shown, the end faces 114, 116, which include the cavity wall 110, have recesses 230 for receiving re-bar, if that is desired. The bottom 234 of each recess 230 is preferably curved to accommodate the size and shape of the re-bar. The chambers 220 and 212 and the recess 214 are open passages that extend through the stretcher block 120.

Figure 2B:
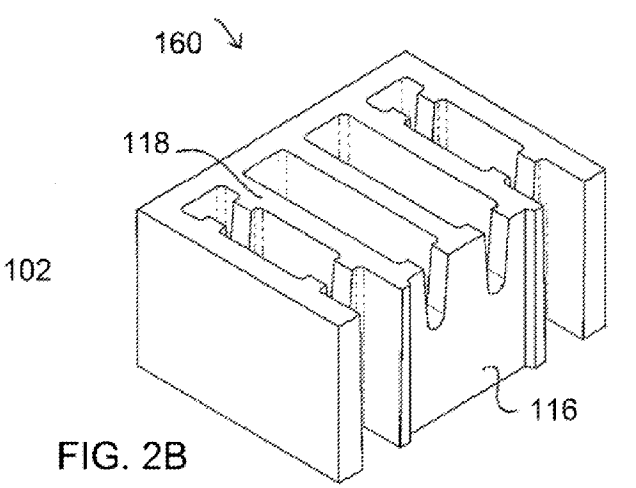
FIG. 2B is a second perspective view of the end block, showing the first wall face and the inner end face.
Figure 2D:
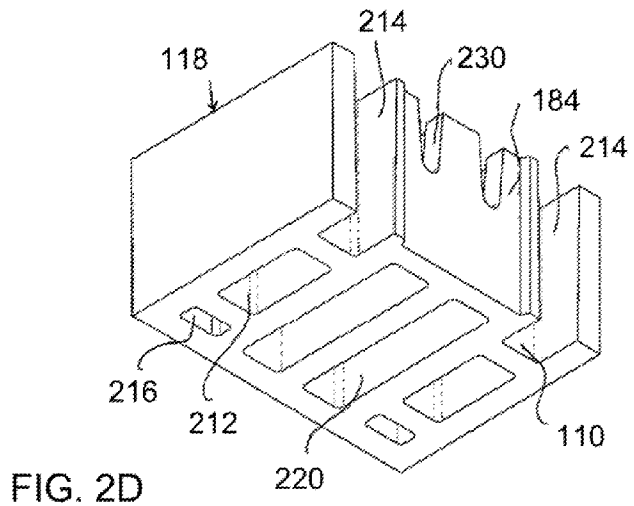
FIG. 2D is a fourth perspective view of the end block, showing the bottom face and the inner end face.
Figure 2A:
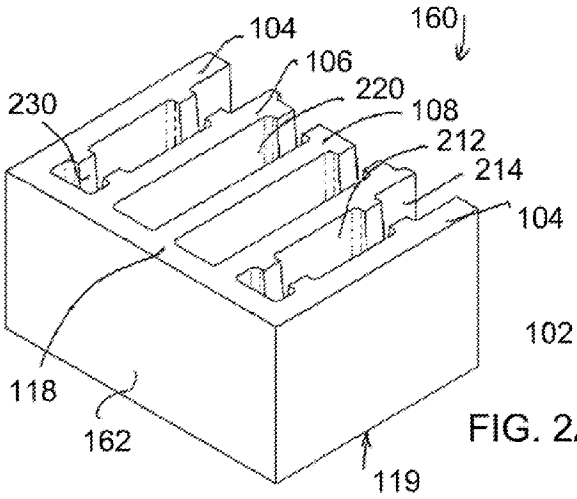
FIG. 2A is a first perspective view of an end block, showing a first wall face, the top face, and an outer end face.
Figure 2C:
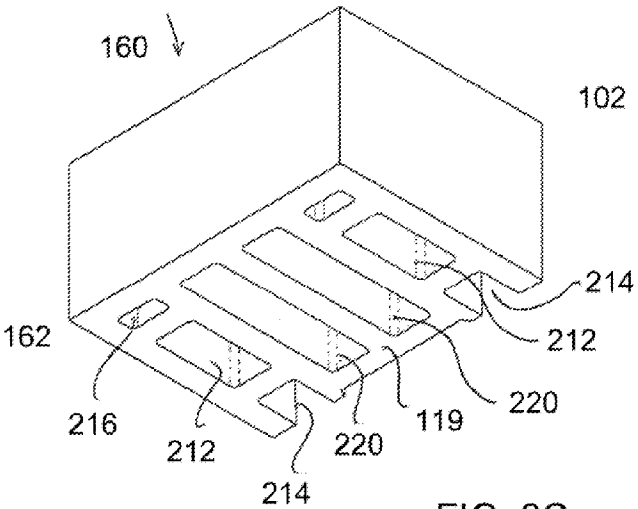
FIG. 2C is a third perspective view of the end block, showing the outer end face and the bottom face.
Figure 2E:
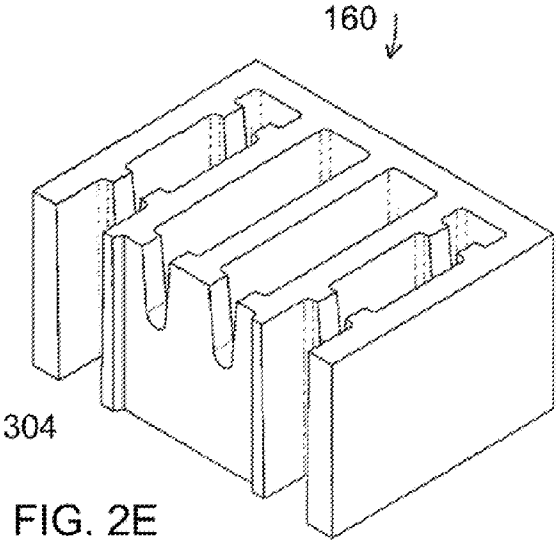
FIG. 2E is a fifth perspective view of the top plan view of the end block, showing the top face, the inner end face and the second wall face.
Figure 2H:
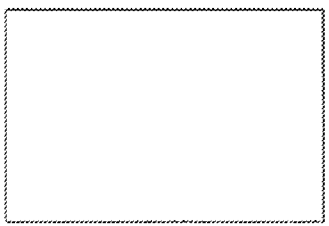
FIG. 2H is a planar view of a wall face of the end block.
Figure 2F:
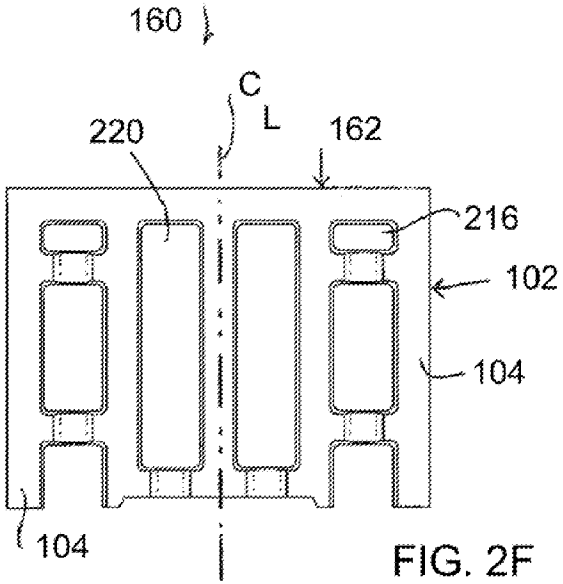
FIG. 2F is a planar view of the end block, showing the top face.
Figure 2G:
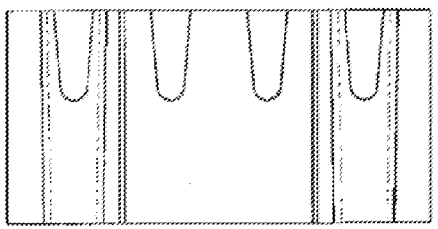
FIG. 2G is a planar view of the end block, showing the inner end face.
Figure 5:
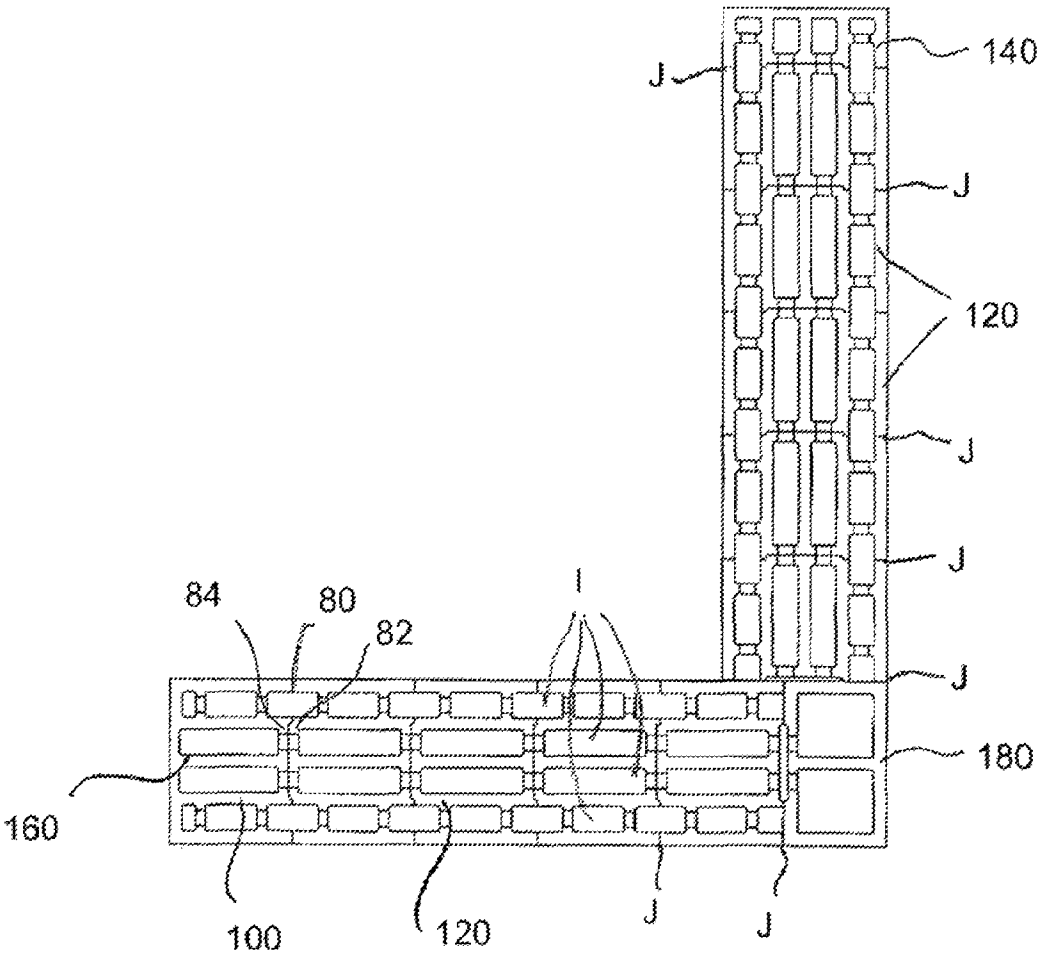
FIG. 5 is a top plan view of a wall constructed of the building block system according to the invention.

FIGS. 2A-2F are perspective views of the end block 160, which has the two wall faces 102 and the second end face 116 described above in connection with the stretcher block 120, but the first end face is a solid outer end face 162. FIGS. 2F-2H are planar views of the end block. A comparison of the end block 160 with the stretcher block 120 reveals that the end block 160 is very similar in construction to the stretcher block, but that the first end face 114 with the male connector 302 has been replaced by the solid outer end face 162. What would normally have been recesses 214 that opened into the first end face are now end chambers 216. With this exception, the rest of the elements of the stretcher block 120 are seen in this end block 160, i.e., the webs 104, 106, 108, the recesses 214 and 213, the female connector 302 on the second end face, and the chambers 220 and 212. This end block 160 is used to finish off the end of a wall, as shown in FIG. 5. As shown in the figures, the recess 214 and chambers 216 are open passages that extend through the block 160.

Figure 3A:
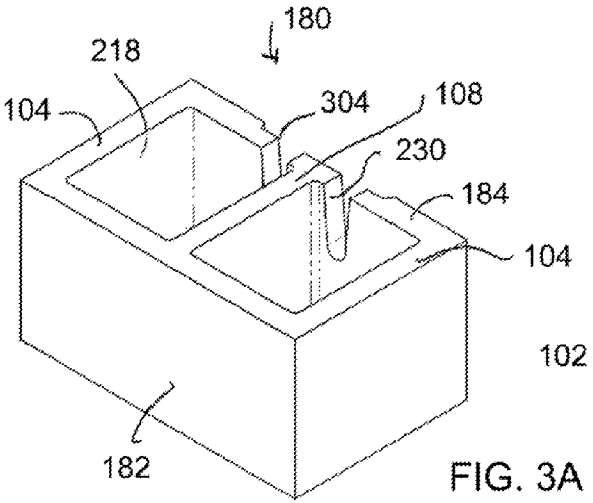
FIG. 3A is a first perspective view of a corner block, showing a first wall face, a top face, and an outer end face
Figure 3B:
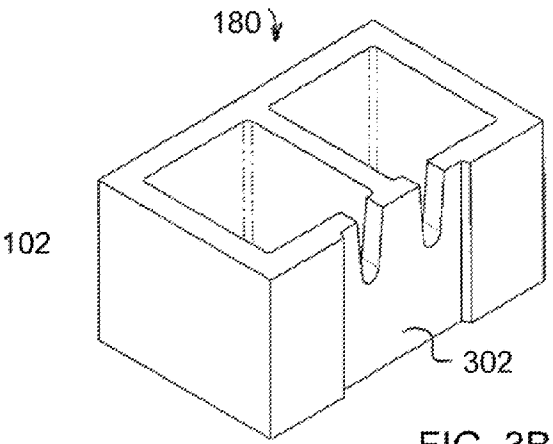
FIG. 3B is a second perspective view of the corner block, showing the top face, the second wall face, and an inner end face.
Figure 3C:
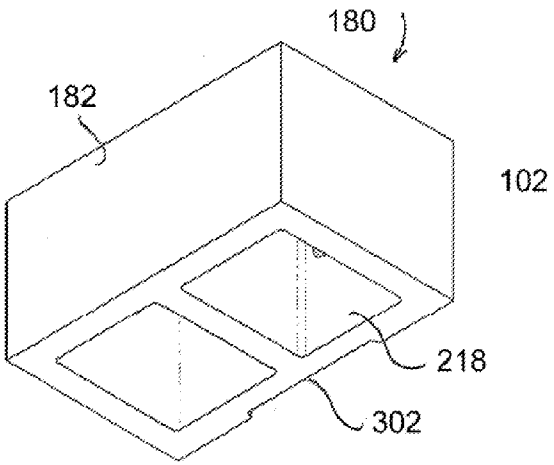
FIG. 3C is a third perspective view of the corner block, showing the bottom face and the outer end face.
Figure 3D:
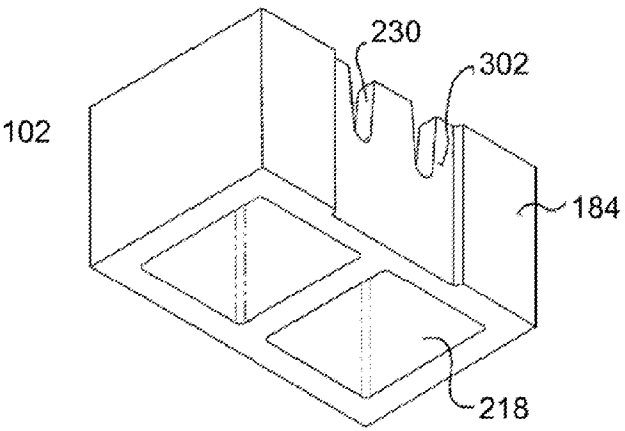
FIG. 3D is a fourth perspective view of the corner block, showing the bottom face, the first wall face, and the inner end face.
Figure 3E:
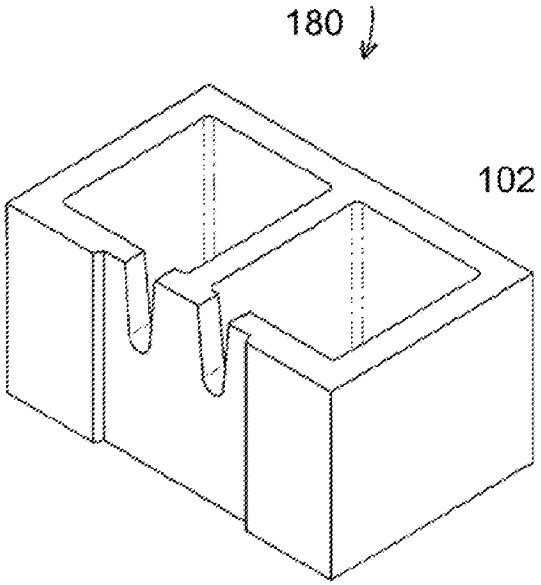
FIG. 3E a fifth perspective view of the corner block, showing the second wall face, the top face, and the inner end face.
Figure 3H:
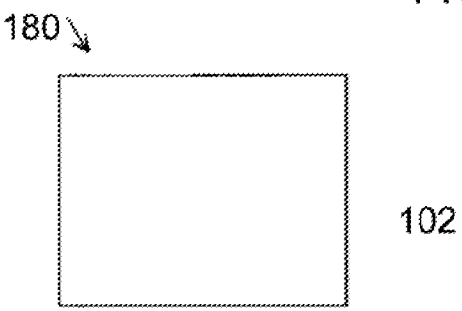
FIG. 3H is a planar view of a wall face of the corner block.
Figure 3F:
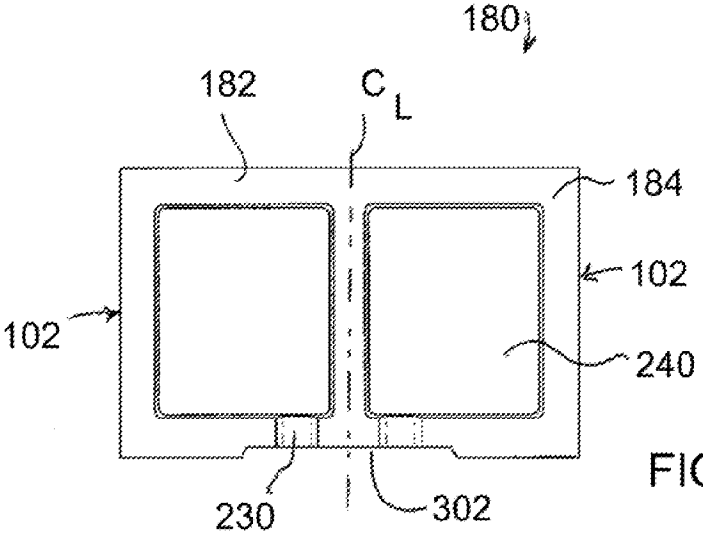
FIG. 3F is a planar view of the corner block, showing the top face.
Figure 3G:
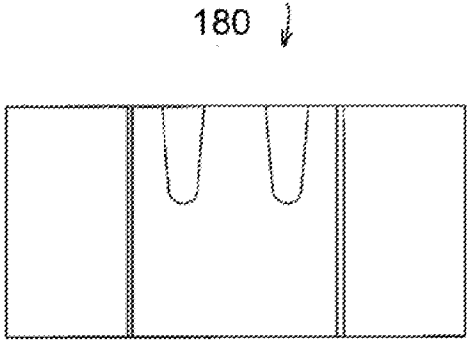
FIG. 3G is a planar view of the corner block, showing the inner end face.

FIGS. 3A-3E are perspective views and FIGS. 3F-3G planar views of the corner block 180, which is used to form a corner in a wall, as shown in FIG. 5. The corner block 180 has the wall faces 102, a first end face that is now a solid wall 182, and a second end face 184 that includes the female connector 304 with the recesses 230. Arranged symmetrically about the centerline $C_L$ are two large chambers 218 that are bounded by the outer webs 104, a center web 108, and the second end face 184. As with the chambers in the other blocks, the large chambers 218 are open passageways through the block 180.

Figure 4B:
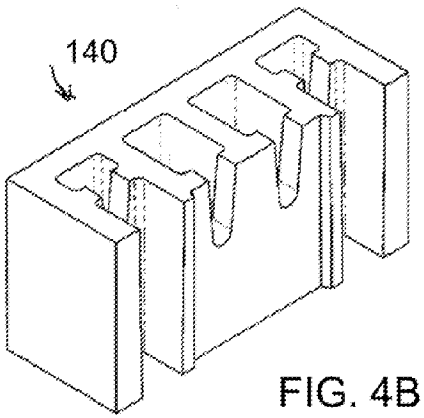
FIG. 4B is a second perspective view of the half block, showing a second wall face, the top face, and the inner end face.
Figure 4D:
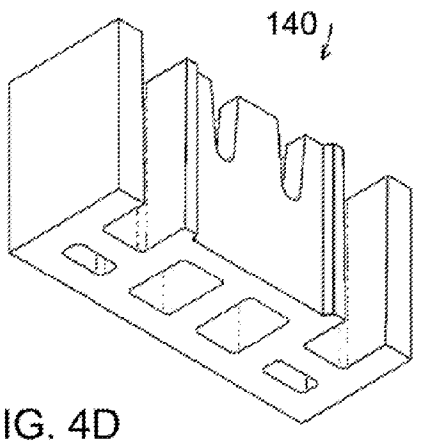
FIG. 4D is a fourth perspective view of the half block, showing the bottom face, the second wall face, and the inner end face.
Figure 4A:
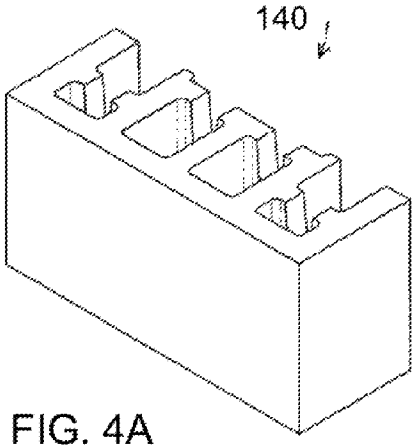
FIG. 4A is a first perspective view of a half block, showing a first wall face, an outer end face and a top face.
Figure 4C:
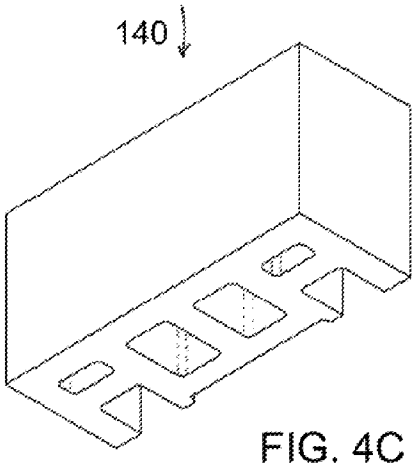
FIG. 4C is a third perspective view of the half block, showing the bottom face, the outer end face and the first wall face.
Figure 4E:
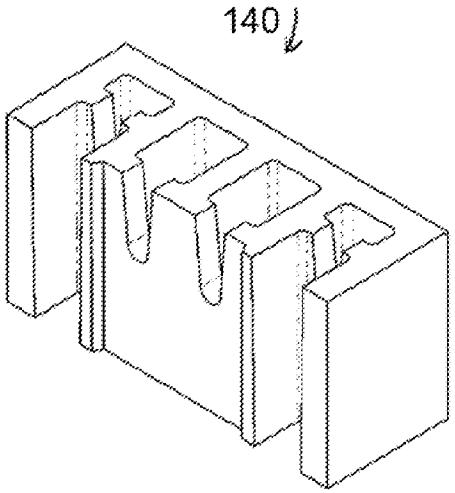
FIG. 4E is a fifth perspective view of the half block, showing the second wall face and the inner end face.
Figure 4F:
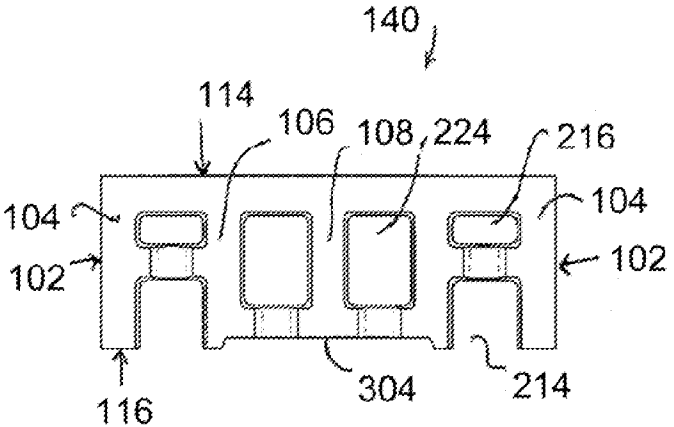
FIG. 4F is a planar view of the half block, showing the top face.
Figure 4H:
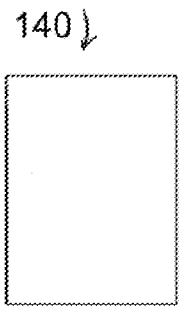
FIG. 4H is a planar view of the half block, showing a wall face.
Figure 4G:
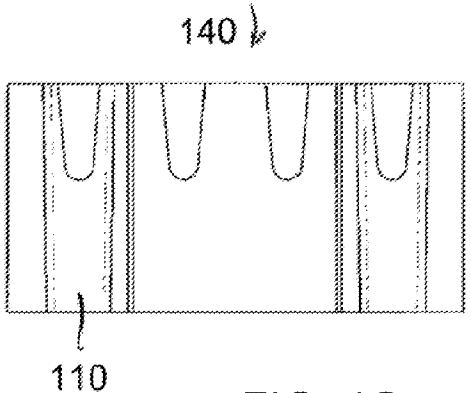
FIG. 4G is a planar view of the half block, showing the inner end face.

FIGS. 4A-4F are perspective views and FIGS. 4F-4G planar view of the half block 140. This block is used as an end block, in place of the full-size end block 160, so that the blocks 100 may be laid on bond relative to the previously laid course of blocks 100. In other words, the half block 140 and the end block 160 are used in alternating rows at the corner, to that the joint formed by the end faces of two adjacent blocks will be over the approximate center of the block 100 in the course just below. See the half block 140 in FIG. 5. The construction of this half block 140 is very similar to that of the end block 160, in that it has the wall faces 102, the recesses 214 and cavities 216. The center chamber 220 is now a truncated half-block chamber 224. As with the other blocks, the chambers 214, 216, and 218 are open passages through the block 140.

FIG. 5 illustrates a course of a wall constructed with the building block 100 according to the invention. The course of wall starts with an end block 160. Stretcher blocks 120 are interconnected with each other by the connector 80. In the embodiment shown, the wall includes a first wall and a second wall that extends at a 90-degree angle to the first wall. At the corner, a corner block 180 is used to bring the wall to the desired length and provide a finished outer face on three sides. Stretcher blocks 120 are then laid out along the second wall. In this particular course, the second wall is finished off with a half block 140. If another course of blocks 100 were to be laid on top of this course, an end block 160 would be placed on top of the half block 140, so that a joint J formed by two adjacent blocks 100 in one course is staggered relative to a joint J of the preceding course.

In the layout of blocks 100 shown in FIG. 5, one can see that the recesses 214 of one block 100 align with the recesses 214 of the adjacent block. This is also the case with the recesses 230. These recesses together form a chamber that may be filled with insulation. Re-bar is placed in the chambers 220 and the recesses 230. These chambers and recesses are then filled with cement grout, to fix the re-bar in position. Forming a rectangular grid with re-bar in a masonry block wall is common practice in the industry and is not described herein.

Figure 6:
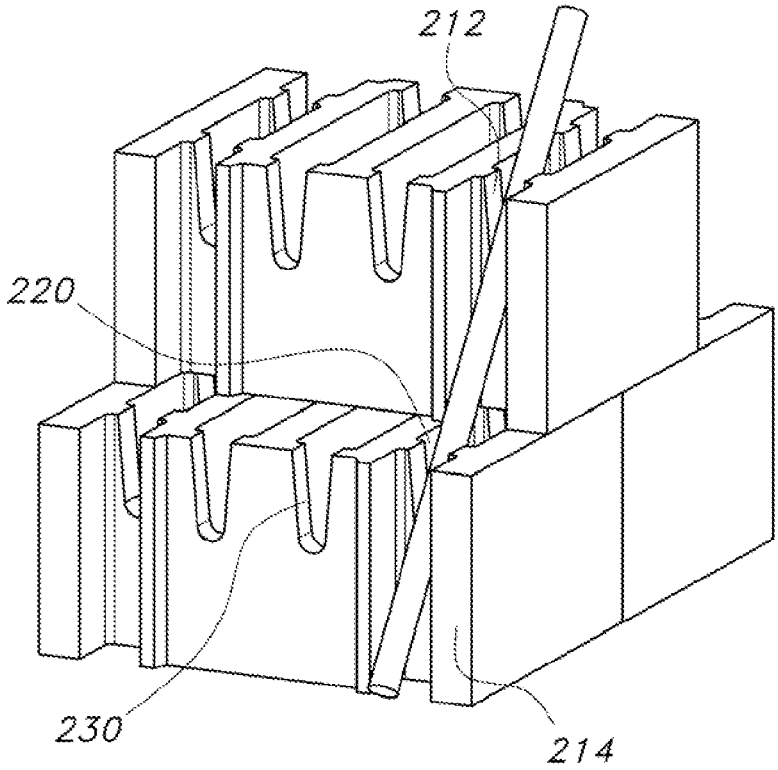
FIG. 6 perspective view of two courses of block laid on bond, showing re-bar placed diagonally through several rows of the masonry block according to the invention.
Figure 7:
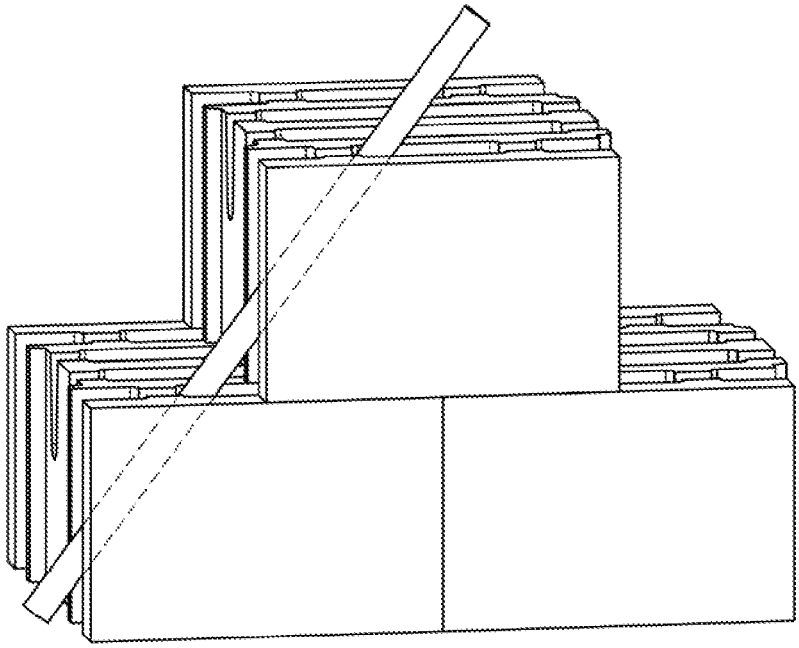
FIG. 7 is a side elevation view of the two courses shown in FIG. 6.

FIGS. 6 and 7 illustrate re-bar placed into a wall in a diagonal orientation. The recesses 230 and chambers 220 of adjacent blocks in the horizontal and vertical direction, when laid on bond, provide an unobstructed path for placing re-bar in the wall diagonally, as do the recesses 214 and chambers 212. When constructing a wall, the re-bar may be placed any one of an aligned series of recesses and chambers. The re-bar shown in FIGS. 6 and 7 is placed diagonally in an outer series of recesses 214 and chambers 212, but can just as well be placed in an inner series of recesses 230 and chambers 220. Because the recess 214 is recessed back from the face 114 and the recess 230 is not, placing the re-bar in the one or other series will result in a change in the angle relative to the horizontal. For example, the re-bar placed in the inner series will extend upward at an angle, relative to the horizontal, of approximately 55 degrees, in the outer series approximately 50 degrees. Re-bar inserted diagonally often provides greater strength in problem areas within a wall and provides alternative methods of reinforcing walls, to accommodate various forces exerted on the wall. Re-bar is typically not inserted diagonally in a conventional masonry wall, because conventional masonry blocks to not provide unobstructed pathways in the diagonal direction.

The blocks 100 are made in standard sizes, but it is understood that the true size may be slightly smaller than the nominal dimension, for example, 12 inches or 10 inches, to ensure that the size of the wall is kept to specified dimensions.

Figure 8:
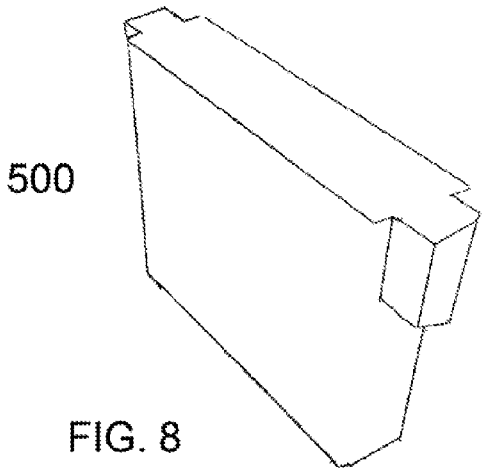
FIG. 8 shows a rigid foam core for use with the masonry block according to the invention.
Figure 9:
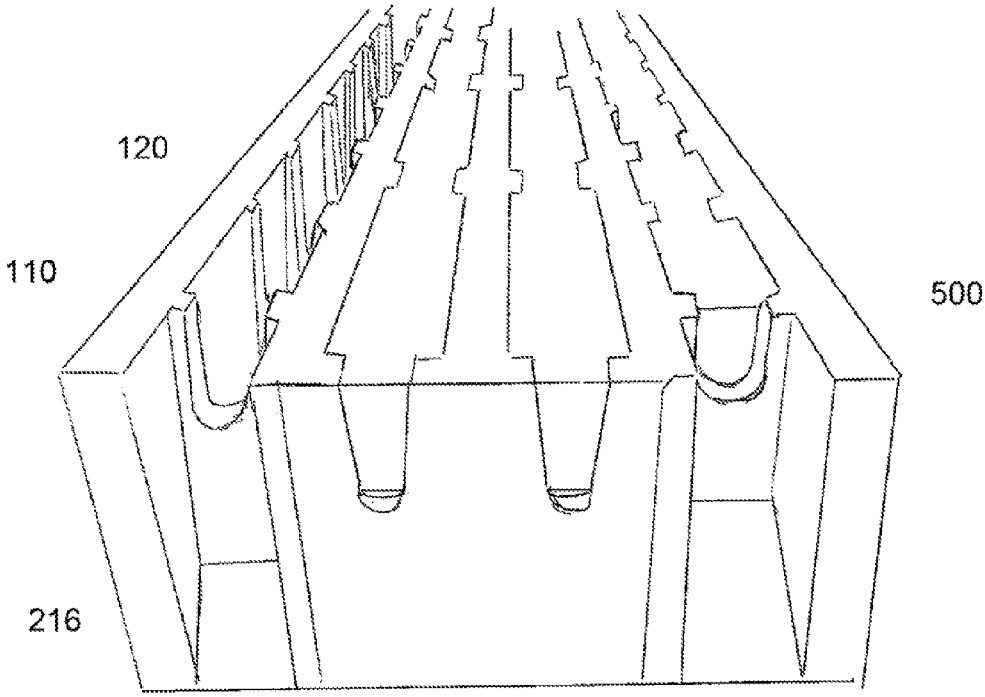
FIG. 9 illustrates a series of masonry blocks with foam cores inserted into the chambers.

FIG. 8 shows a foam insulation core 500 that has been molded to fit the cavities in the masonry block 100. FIG. 9 shows a series of blocks 120 with cores 500 inserted into cavities in the two central chambers and in one outer chamber. It is intended with this particular configuration that re-bar be laid in the open row of outer chambers and these chambers then filled with grout. This figure is only to illustrate one way to reinforce and insulate a wall. Depending on the particular foreseeable stresses on the wall to be constructed, the re-bar may be laid in any one of the chambers and/or may be inserted vertically down through a number of courses of the masonry block 100.

It is understood that the embodiments described herein are merely illustrative of the present invention. Variations in the construction of the masonry block system 100 may be contemplated by one skilled in the art without limiting the intended scope of the invention herein disclosed and as defined by the following claims.

What is claimed is:

1. A masonry block comprising:

a stretcher block that is substantially rectangular, the four sides of the block including two wall faces, a first end face, and a second end face, the first end face having a male connector and the second end face a female connector, wherein the male connector is adapted to mate with the female connector of an adjacent block, the two wall faces being the faces of the block that are visible when the wall is constructed, an upper face and a lower face of the block being open;

a central portion located between the male connector and the female connector, wherein the central portion has a first and a second central chamber separated by a central web, the central web defining a central axis and the first and second central chambers having a longitudinal axis that extends parallel to the central axis, and wherein the first and second end faces in the central portion have a first recess and a second recess, each recess aligned with the longitudinal axis of the respective first and second central chambers; and a first outer chamber between the first central chamber and the first wall face and a second outer chamber between the second central chamber and the second wall face, each outer chamber being separated from the corresponding central chamber by an intermediate web and bounded by a first cavity wall on the first end face and a second cavity wall on the second end face;

wherein the first end face has a connector for mating with a connector of an adjacent block, at least one chamber for receiving insulation, and at least one recess for receiving a reinforcing bar.

2. The masonry block of claim 1, wherein the first and second cavity walls have a recess in an upper portion of the wall that is adapted to receive the reinforcing bar.

3. The masonry block of claim 2, wherein the first and second cavity walls are recessed inward from the outermost plane of the respective first and second end faces.

4. The masonry block of claim 1, wherein the intermediate web has a web length that defines a dimension of the stretcher block and wherein the male connector is a portion of the first end face that extends beyond the web length and the female connector is a portion of the second end face that is recessed inward relative to the web length.

5. A masonry block of comprising: an end block that is substantially rectangular, the four sides of the block including two wall faces, a first end face being a flat face that forms a wall end face, and a second end face having a connector for mating with a connector of an adjacent block; the end block further having a central portion located between the wall end face and the connector, wherein the central portion has a first and a second central chamber separated by a central web, the central web defining a central axis and the first and second central chambers having a longitudinal axis that extends parallel to the central axis, and wherein the second end face in the central portion has a first recess and a second recess, each recess aligned with the longitudinal axis of the respective first and second central chambers; and a first outer chamber between the first central chamber and the first wall face and a second outer chamber between the second central chamber and the second wall face, each outer chamber being separated from the corresponding central chamber by an intermediate web and bounded by a cavity wall on the first end face.

6. The masonry block of claim 5, wherein the cavity wall has a recess in an upper portion of the wall that is adapted to receive the reinforcing bar.

7. The masonry block of claim 5, wherein the cavity wall is recessed inward from the outermost plane of the first end face.

8. The masonry block of claim 5, wherein the intermediate web has a web length that defines the dimension of the end block and wherein the connector is a portion of the first end face that is recessed inward relative to the web length.

9. A masonry block comprising: a corner block that is substantially rectangular, the four sides of the block including two wall faces, a first end face and a second end face, wherein the first end face is a flat face that forms a wall end face, wherein the second end face has a connector for mating with a connector or an adjacent block, and wherein a central portion is located between the connector and the wall end face, the central portion having a first and a second central chamber separated by a central web, the central web defining a central axis and the first and second central chambers having a longitudinal axis that extends parallel to the central axis, and the second end face in the central portion has a first recess on a first side of the central web and a second recess on a second side of the central web, each recess aligned with the longitudinal axis of the respective first and second chambers.

* * * * *